US010639646B2

(12) United States Patent
Chen

(10) Patent No.: US 10,639,646 B2
(45) Date of Patent: May 5, 2020

(54) LOW TEMPERATURE PLASMA AIR PURIFIER WITH HIGH SPEED ION WIND SELF-ADSORPTION

(71) Applicant: SHENZHEN JIARUNMAO ELECTRONIC CO., LTD, Shenzhen, Guangdong (CN)

(72) Inventor: Shunpeng Chen, Guangdong (CN)

(73) Assignee: SHENZHEN JIARUNMAO ELECTRONIC CO., LTD, Shenzhen (CN)

( * ) Notice: Subject to any disclaimer, the term of this patent is extended or adjusted under 35 U.S.C. 154(b) by 323 days.

(21) Appl. No.: 15/680,233

(22) Filed: Aug. 18, 2017

(65) Prior Publication Data

US 2017/0341088 A1 Nov. 30, 2017

Related U.S. Application Data

(63) Continuation-in-part of application No. PCT/CN2016/094773, filed on Aug. 11, 2016.

(30) Foreign Application Priority Data

Jan. 29, 2016 (CN) ..... 2016 2 0090749 U

(51) Int. Cl.
*B03C 3/41* (2006.01)
*B03C 3/09* (2006.01)
(Continued)

(52) U.S. Cl.
CPC ..... *B03C 3/41* (2013.01); *B03C 3/09* (2013.01); *B03C 3/12* (2013.01); *B03C 3/363* (2013.01);
(Continued)

(58) Field of Classification Search
CPC combination set(s) only.
See application file for complete search history.

(56) References Cited

U.S. PATENT DOCUMENTS 3,151,259 A * 9/1964 Gloersen ..... F03H 1/00 310/11
3,258,897 A * 7/1966 Mayer ..... B03C 3/38 96/76
(Continued)

FOREIGN PATENT DOCUMENTS

CN 2671583 Y 1/2005
CN 2671585 Y 1/2005
(Continued)

OTHER PUBLICATIONS

International Search Report of PCT Patent Application No. PCT/CN2016/094773 dated Oct. 31, 2016.

*Primary Examiner* — Amber R Orlando
*Assistant Examiner* — Sonji Turner

(57) ABSTRACT

The present invention discloses a low temperature plasma air purifier with high speed ion wind self-adsorption, which comprises a power module releasing a high-voltage direct current, a housing functioning as a support, an emitter electrode generating a strong ionization field, and a dust collecting electrode adsorbing various particles, wherein the emitter electrode comprises one or more needle-like conductors, circular holes fitted with each of the needle-like conductors are provided on the dust collecting electrode. The present invention has a simple structure and a small size, and realizes a high purification speed without the assistance of fans. The porous metal structure of the dust collecting electrode increases the contact area for air purification so that the dust collecting electrode has a strong adsorbability, which ensures a good air purification effect.

5 Claims, 5 Drawing Sheets

(51) Int. Cl.

| | |
|---|---|
| ***B03C 3/36*** | (2006.01) |
| ***B03C 3/47*** | (2006.01) |
| ***B03C 3/12*** | (2006.01) |
| ***B03C 3/60*** | (2006.01) |

(52) U.S. Cl.
CPC ..... *B03C 3/368* (2013.01); *B03C 3/47* (2013.01); *B03C 3/60* (2013.01); *B03C 2201/06* (2013.01)

(56) References Cited

U.S. PATENT DOCUMENTS 4,227,894 A * 10/1980 Proynoff ..... B03C 3/38 361/231
4,904,283 A * 2/1990 Hovis ..... B03C 3/155 96/66
4,955,991 A * 9/1990 Torok ..... B03C 3/38 96/50
4,976,752 A * 12/1990 Torok ..... B03C 3/38 361/230
5,474,600 A * 12/1995 Volodina ..... A61L 9/22 96/223
5,484,472 A * 1/1996 Weinberg ..... A61N 1/44 323/903
5,950,424 A * 9/1999 Nojima ..... B03C 3/011 60/275
6,168,689 B1 * 1/2001 Park ..... B01D 53/323 204/164
6,228,149 B1 * 5/2001 Alenichev ..... B03C 3/025 361/233
6,497,753 B1 * 12/2002 Gutmann ..... B03C 3/025 96/381
6,508,982 B1 * 1/2003 Shoji ..... A61L 9/22 204/164
6,544,485 B1 * 4/2003 Taylor ..... A61L 9/015 422/121
7,042,159 B2 * 5/2006 Tanaka ..... B01D 53/32 315/111.21
7,052,531 B2 * 5/2006 Kishioka ..... B03C 3/025 55/DIG. 29
8,673,068 B2 * 3/2014 Volodin ..... A61L 9/22 55/DIG. 38
9,259,742 B2 * 2/2016 Roux ..... B03C 3/12
2011/0209621 A1 * 9/2011 Volodin ..... A61L 9/22 96/79

FOREIGN PATENT DOCUMENTS

CN 2688390 Y 3/2005
CN 204014244 U 12/2014
CN 104990106 A 10/2015
CN 104990139 A 10/2015
CN 105080300 A 11/2015
DE 3930872 A1 * 3/1991 ..... B03C 3/06
JP 2002343535 A 11/2002
JP 2002361028 A 12/2002
JP 2003275291 * 9/2003 ..... F24F 7/00

* cited by examiner

LOW TEMPERATURE PLASMA AIR PURIFIER WITH HIGH SPEED ION WIND SELF-ADSORPTION

CROSS-REFERENCE TO RELATED APPLICATION

This application is a continuation-in-part application of PCT Application No. PCT/CN2016/094773 filed on Aug. 11, 2016, which claims priority to Chinese Application No. 201620090749.4 filed on Jan. 29, 2016, the entire contents of which are hereby incorporated by reference.

TECHNICAL FIELD

The present disclosure relates to the technical field of low temperature plasma air purification, particularly to a low temperature plasma air purifier with high speed ion wind self-adsorption.

BACKGROUND

In view of the limited indoor space and bad quality of outdoor air in some cities, the indoor environment itself has no natural ability to purify. Interior decoration, use of air conditioners and human daily life are continuously discharging volatile organic gases, solid suspended particles, aerosols and other harmful substances, which causes pollution of indoor air and resulting health hazardous. The main indoor pollutants include dust, mold, total volatile organic compounds (TVOC) and other formaldehyde and benzene, and as a result, concern over the quality of indoor air has been growing with improvement of the living standards.

The quality of indoor air may be improved by (1) air filtration: a device for air filtration comprises a fan, and primary-effect, medium-effect and high-effect (sub-high-effect) filters using main filter media of glass fiber, synthetic fiber, asbestos fiber and filter paper or filter cloth made of these fibers, and materials with adsorbability, like activated carbon, to purify the air by filtering the dust and odor, but these porous filter media increase the resistance to the air flow with a filtering effect decreasing over time, and make the air pollution worse or even result in secondary pollution if not timely replaced; (2) electrostatic precipitation: the dust in the circulating air is charged and then the charged dust is collected by a dust collecting device for the purpose of air purification, but this method cannot kill airborne bacteria or remove toxic odor gases like TVOC, and it uses an integrated board not easy to set up and clean; (3) ultraviolet sterilization: ultraviolet rays are used to kill bacteria in the air, which however can do nothing about dust in the air and thus are not able to purify the air; (4) low temperature plasma purification: water molecules and gas molecules in the air are ionized through the strong ionization field generated by a low temperature plasma generator and gas discharge, and active groups of extremely active chemical properties are produced after a series of complex excitation, dissociation and ionization processes, which react with pollutants in the air in a series of complex redox reactions to decompose volatile organic molecules therein so as to purify the air, these radicals also have such a strong inactivation effect for microbes that they achieve the purpose of sterilization while eliminating the organic pollution, and moreover, dust is charged and made heavier through inelastic collision with charged particles so as to be collectively collected and purified.

A plasma air purifier mainly consists of a high voltage power supply and a plasma ionization field. At present, a plasma ionization field may have a structure of a board-to-board type, wire-to-board type, needle-to-board type or wire-to-barrel type. Chinese invention patent CN2688390Y has disclosed a plasma smoke eliminating and dust collecting apparatus having a purifying part consisting of a stainless steel tube, metal molybdenum filaments, a positive electrode plate, and a negative electrode plate, which has technical problems of slow purification speed, unsatisfactory purification effect, and need for assistance of a fan.

SUMMARY

In view of the shortcomings of the prior art, the present invention provides a low temperature plasma air purifier with high speed ion wind self-adsorption.

In order to achieve the above object, the present invention is implemented in the following way:

A low temperature plasma air purifier with high speed ion wind self-adsorption comprises a power module releasing a high-voltage direct current, a housing functioning as a support, an emitter electrode generating a strong ionization field, and a dust collecting electrode adsorbing various particles, wherein the emitter electrode comprises one or more needle-like conductors, circular holes provided on the dust collecting electrode are arranged around each of the needle-like conductors, the one or more needle-like conductors on the emitter electrode are extracted from the power module and directed toward the circular holes on the dust collecting electrode, the power module is detachably secured to the housing or provided separately from the housing, and a plasma region is formed by enclosure of the emitter electrode and the dust collecting electrode.

Further, the circular hole has an arc-shaped transition section on the inner wall at the opening thereof, and the transition section is provided at a position where the needle-like conductor is inserted, so as to facilitate the air flow through the circular hole and effectively increase the wind speed to achieve the characteristic of high speed self-adsorption.

Furthermore, the arc of the transition section has a chamfer angle of generally 5° to 170°, preferably 15° to 75°.

Further, the conductor of the emitter electrode has a length of 2 mm to 20 mm, preferably 5 mm to 15 mm.

In the invention, the needle-like conductor is composed of a cylindrical body and a pointed tip in an integrated structure, one end of the cylindrical body connected to the high voltage power supply circuit and the other end thereof formed as the pointed tip, and the pointed tip of each needle-like conductor is directed toward the center of the corresponding circular hole on the dust collecting electrode.

In the invention, the dust collecting electrode and the power module are electrically connected through a wire extracted from the power module, the circular holes on the dust collecting electrode are arranged in a circular array or a rectangle array, and the circular holes have a bore diameter of 5-50 mm.

In the invention, the air purifier further comprises an air guide cone preventing the dust from gathering, which has a curved cone structure and is accommodated within the housing, with a tip part pointed at an air inlet of the housing.

In the invention, the air purifier further comprises a cover provided at the air inlet of the housing, a plurality of grooves with attachment legs provided on the housing, and the cover and the housing in direct communication and detachable from each other.

The beneficial effects of the present invention are as follows:

Compared with the prior art, in the low temperature plasma air purifier with high speed ion wind self-adsorption of this invention, the power module generates a high voltage and is connected to the emitter electrode, the strong ionization field region generated by the electric electrode produces high speed electrons directed to the dust collecting electrode and generates a plasma region around the needle tips, and a wind is formed when electrons and charged particles moving at a high speed collide inelastically with and adhere to contaminant molecules and other particles in the air to move together toward the dust collecting electrode. Dust adheres, by inelastic collision, to electrons moving at a high speed when passing through the plasma region generated by the emitter electrode, and under the action of electrostatic forces, negatively charged particles move toward the dust collecting electrode to adhere thereto, thereby accomplishing the purification of particulate matter in the air. TVOC, formaldehyde, and fungus molecules are subjected to oxidative decomposition when passing through the plasma region as their molecules are directly oxidized and destroyed by high-energy electrons and oxidized groups generated in the plasma region, and moreover, high-speed high-energy charged particles have penetrating damages to virus and fungus cells and thus are able to kill them.

The present invention realizes a high purification speed and a good purification effect with a simple structure and a small size, without the assistance of fans. The porous metal structure of the dust collecting electrode increases the contact area for air purification so that the dust collecting electrode has a strong adsorbability. Using the low temperature plasma technique achieves low power consumption and remarkable energy saving and silencing effects.

REFERENCE NUMERALS

10. Power module;
11. Housing;
12. Emitter electrode;
13. Dust collecting electrode;
14. Air guide cone;
15. Cover;
121. Needle-like conductor;
131. Circular hole.

DETAILED DESCRIPTION

Here is a detailed description with reference to the drawings to explain the invention more clearly.

Figure 1:
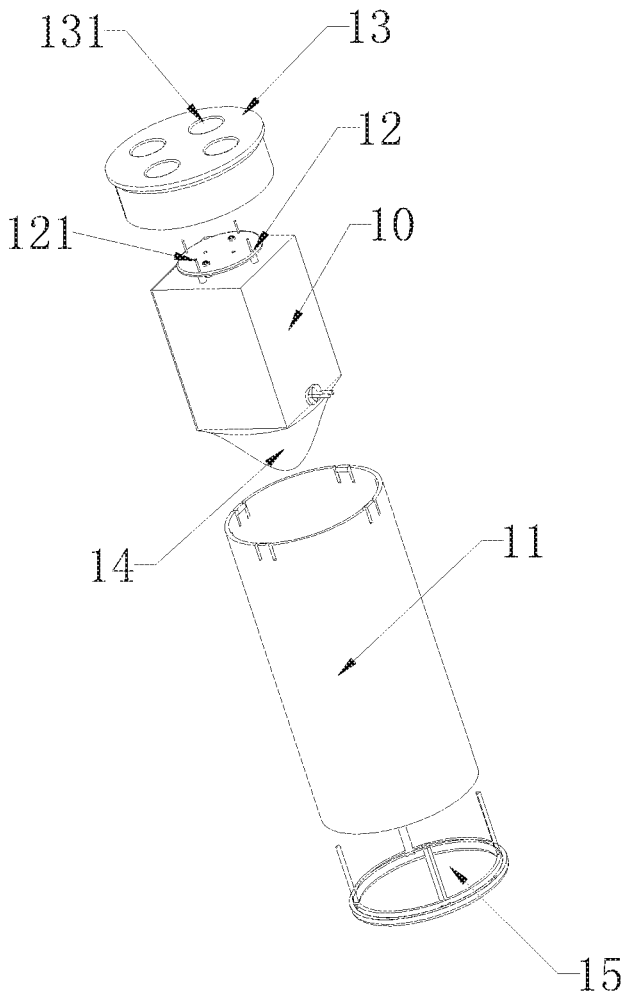
FIG. 1 is an exploded view of a low temperature plasma air purifier with high speed ion wind self-adsorption of this invention with an internal power supply.
Figure 2:
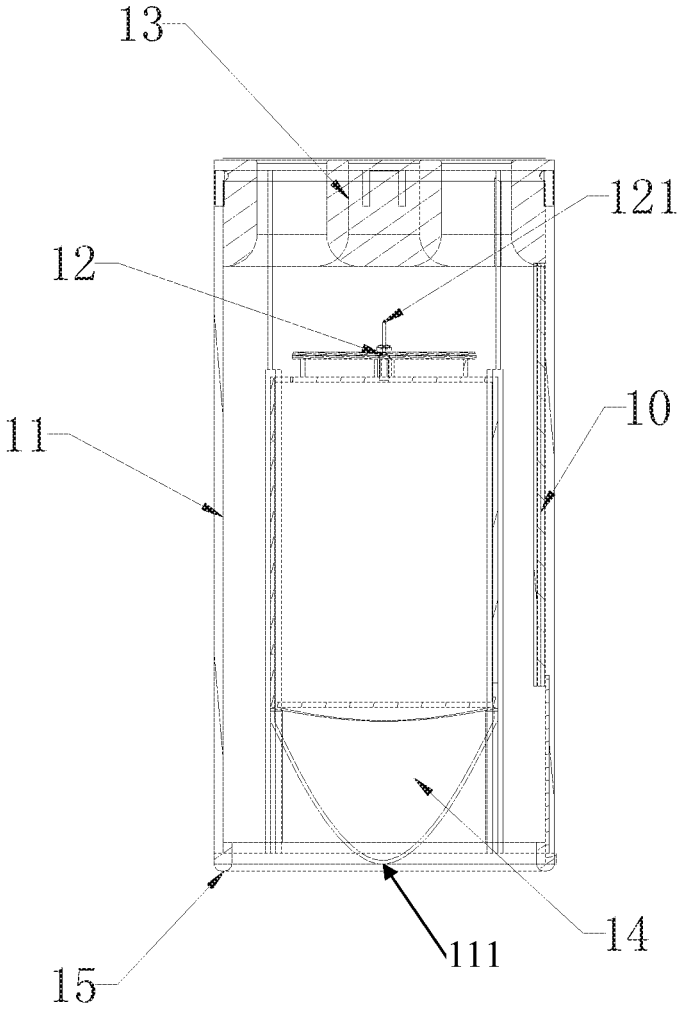
FIG. 2 is a sectional view of the low temperature plasma air purifier with high speed ion wind self-adsorption of this invention.

As shown in FIGS. 1 and 2, in this invention, a low temperature plasma air purifier with high speed ion wind self-adsorption comprises a power module 10 releasing a high-voltage direct current, a housing 11 functioning as a support, an emitter electrode 12 generating a strong ionization field, and a dust collecting electrode 13 adsorbing various particles, wherein the emitter electrode 12 comprises one or more needle-like conductors 121, circular holes 131 provided on the dust collecting electrode 13 are arranged around each of the needle-like conductors 121, the one or more needle-like conductors 121 on the emitter electrode 12 are extracted from the power module 10 and directed toward the circular holes 131 on the dust collecting electrode 13, the power module 10 is detachably secured to the housing 11 or provided separately from the housing 11, and a plasma region is formed by enclosure of the emitter electrode 12 and the dust collecting electrode 13.

According to one aspect of the invention, the emitter electrode 12 is provided as comprising a plurality of needle-like conductors 121, circular holes 131 provided on the corresponding dust collecting electrode 13 are arranged around each of the needle-like conductors 121, and the circular hole 131 has an arc-shaped transition section on the inner wall at the opening thereof. Such design, especially the design of the transition section, facilitates the air flow through the circular hole and is able to effectively increase the wind speed, so that the characteristic of high speed self-adsorption is achieved to reduce the size of a plasma air purifier and improve the purification efficiency thereof under the same conditions.

The arc of the transition section has a chamfer angle of generally 5° to 170°, preferably 15° to 75°.

The conductor 121 of the emitter electrode has a length of 2 mm to 20 mm, preferably 5 mm to 15 mm.

Figure 3:
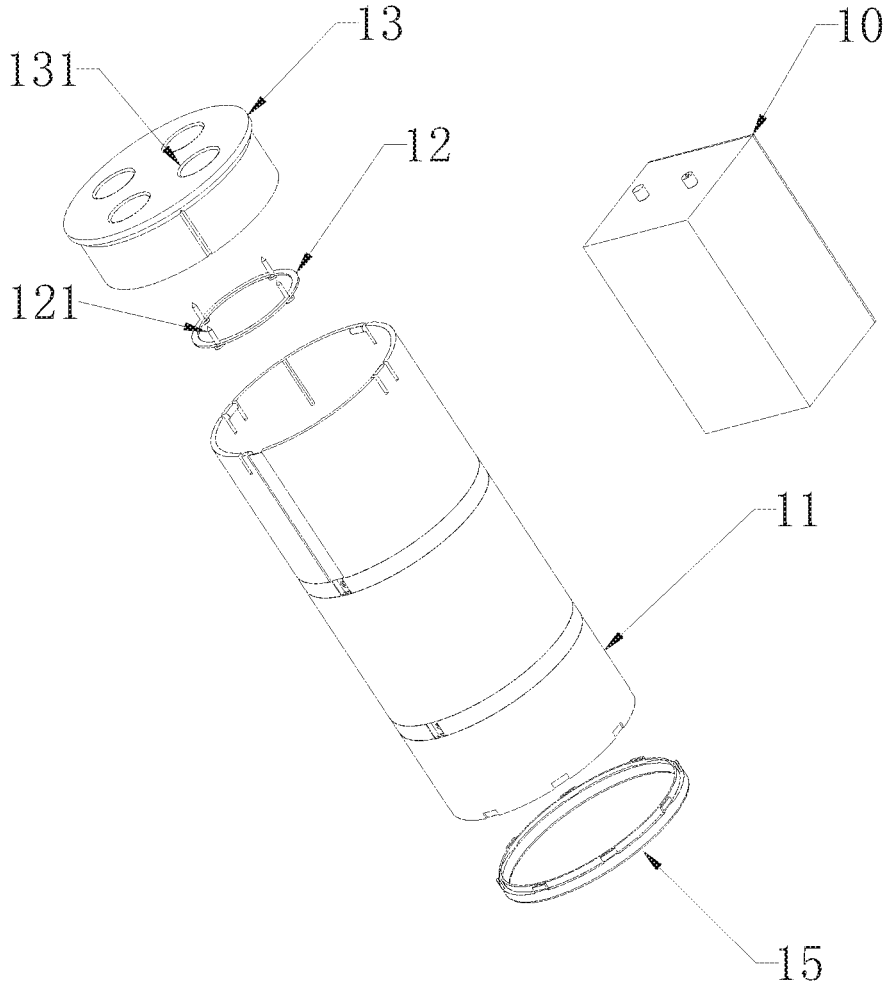
FIG. 3 is an equivalent exploded view of a low temperature plasma air purifier with high speed ion wind self-adsorption of this invention with an external power supply.
Figure 4:
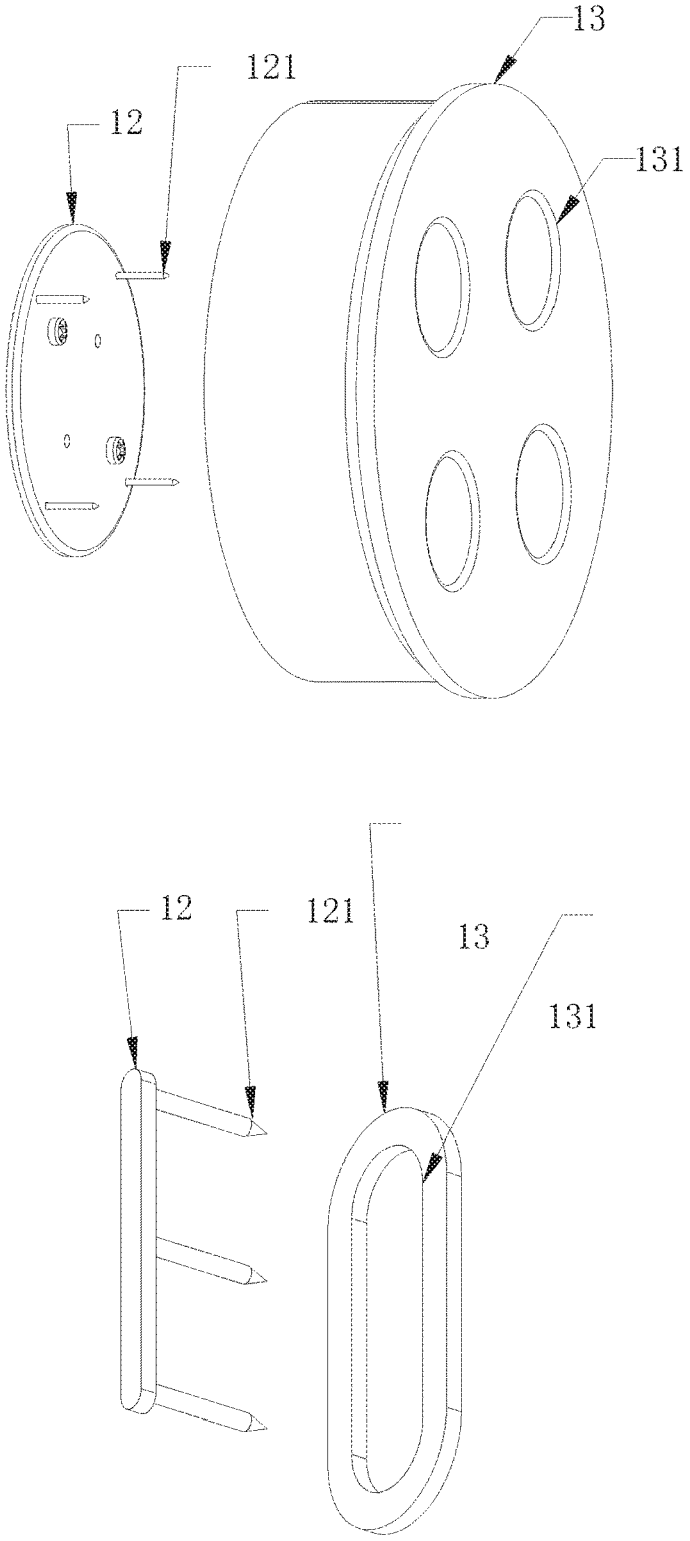
FIG. 4 is an equivalent view of the assembly structure of an emitter electrode and a dust collecting electrode in the low temperature plasma air purifier with high speed ion wind self-adsorption of this invention.

With reference to FIGS. 3 and 4, compared with the prior art, in the low temperature plasma air purifier with high speed ion wind self-adsorption of this invention, the power module 10 generates a high voltage and is connected to the emitter electrode 12, the strong ionization field region generated by the electric electrode 12 produces high speed electrons directed to the dust collecting electrode 13 and generates a plasma region around the needle tips, and a wind is formed when electrons and charged particles moving at a high speed collide inelastically with and adhere to contaminant molecules and other particles in the air to move together toward the dust collecting electrode 13. The arc-shaped transition section facilitates the air flow through the circular holes so that the wind speed is effectively increased. Dust adheres, by inelastic collision, to electrons moving at a high speed when passing through the plasma region generated by the emitter electrode 12, and under the action of electrostatic forces, negatively charged particles move toward the dust collecting electrode 13 to adhere thereto, thereby accomplishing the purification of particulate matter in the air. TVOC, formaldehyde, and fungus molecules are subjected to oxidative decomposition when passing through the plasma region as their molecules are directly oxidized and destroyed by high-energy electrons and oxidized groups generated in the plasma region, and moreover, high speed high-energy charged particles have penetrating damages to virus and fungus cells and thus are able to kill them.

The present invention realizes a high purification speed and a good purification effect with a simple structure and a small size, without the assistance of fans. The porous metal structure of the dust collecting electrode increases the contact area for air purification so that the dust collecting electrode has a strong adsorbability. Using the low temperature plasma technique achieves low power consumption and remarkable energy saving and silencing effects.

As FIG. 3 further shown, the needle-like conductor 121 is composed of a cylindrical body and a pointed tip in an integrated structure, one end of the cylindrical body connected to the high voltage power supply circuit and the other end thereof formed as the pointed tip, and the pointed tip of each needle-like conductor 121 is directed toward the center of the corresponding circular hole 131 on the dust collecting electrode 13. The needle-like conductor 121 is characterized by:

1. the length of the needle being 2-20 mm;
2. the voltage of the emitter electrode 12 being +3 KV-+50 KV; −3 KV-−50 KV;
3. the distance from the emitter electrode 12 to the dust collecting electrode 13 being 5-50 mm.

Figure 5:
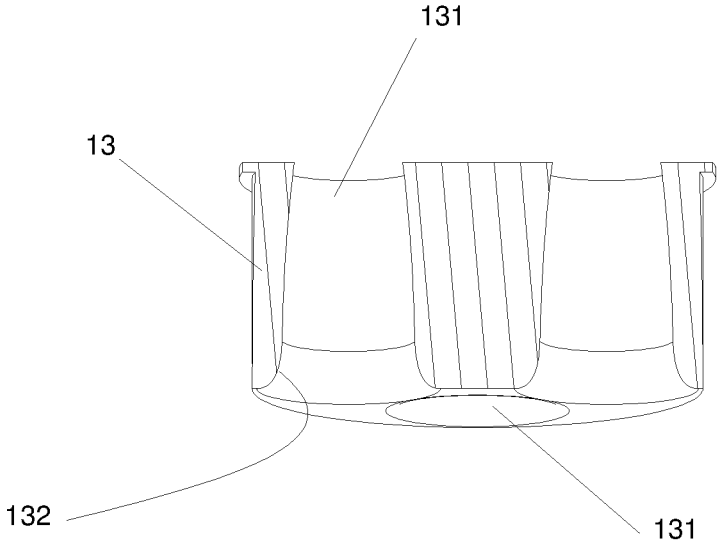
FIG. 5 is a structural view of the dust collecting electrode in the low temperature plasma air purifier with high speed ion wind self-adsorption of this invention.

With reference to FIG. 5, in the embodiment, the dust collecting electrode 13 and the power module 10 are electrically connected through a metal probe extracted from the power module 10, the circular holes 131 on the dust collecting electrode 13 are arranged in a circular array or a rectangle array, the circular hole 131 has a bore diameter of 5-50 mm and has a transition section 132 on one end, the emitter electrode 12 enters the circular hole 131 from one side of the circular hole 131, and the transition section is positioned at the side where the emitter electrode 12 enters the circular hole 131. The dust collecting electrode 13 has an annular structure which is characterized by:

1. the thickness of the ring being 2-200 mm;
2. the chamfer angle at one side of the transition section being 5°-170°;
3. the pore size of the ring being 5-50 mm; and
4. the ring being made of metal materials.

The cross section of the dust collecting electrode may have a shape of circle, oval, triangle, square or polygon, and in the embodiment shown in FIGS. 1 and 5, it has a circular shape.

In the embodiment, the air purifier further comprises an air guide cone 14 preventing the dust from gathering, which has a curved cone structure and is accommodated within the housing 11, with a tip part pointed at an air inlet 111 (referring back to FIG. 2) of the housing 11. Such structure functions to guide the inlet air for prevention of dust gathering with an aerodynamic design.

In the embodiment, the air purifier further comprises a cover 15 provided at the air inlet of the housing 11, a plurality of grooves with attachment legs provided on the housing 11, and the cover 15 and the housing 11 in direct communication and detachable from each other.

The foregoing is only a description of preferred embodiments of the present invention, and is not intended to limit the invention in any way. Any variation that may be made by those of ordinary skill in the art is covered under the protection scope claimed therein.

The invention claimed is:

1. A low temperature plasma air purifier with high speed ion wind self-adsorption, comprising a power module releasing a high-voltage direct current, a housing functioning as a support, an emitter electrode generating a strong ionization field, and a dust collecting electrode adsorbing various particles, wherein the emitter electrode comprises one or more needle-like conductors, circular holes provided on the dust collecting electrode are arranged around each of the needle-like conductors, the one or more needle-like conductors on the emitter electrode that extend from the power module in a direction toward the circular holes on the dust collecting electrode, the power module is detachably secured to the housing or is provided separately from the housing, and a plasma region is formed by communication of the emitter electrode with the dust collecting electrode;

wherein each circular hole has an arc-shaped transition section on an inner wall at an opening thereof, and the transition section is provided at a position where a corresponding needle-like conductor is inserted;

each conductor of the emitter electrode has a length from 2 mm to 20 mm; and the low temperature plasma air purifier further comprises an air guide cone preventing dust from gathering, which has a curved cone structure and is accommodated within the housing, with a tip part pointed at an air inlet of the housing.

2. The low temperature plasma air purifier with high speed ion wind self-adsorption according to claim 1, wherein each conductor of the emitter electrode has a length from 5 mm to 15 mm.

3. The low temperature plasma air purifier with high speed ion wind self-adsorption according to claim 1, wherein each needle-like conductor is composed of a cylindrical body and a pointed tip in an integrated structure, one end of the cylindrical body connected to a high voltage power supply circuit and the other end thereof formed as the pointed tip, and the pointed tip of each needle-like conductor is directed toward a center of a corresponding circular hole on the dust collecting electrode.

4. The low temperature plasma air purifier with high speed ion wind self-adsorption according to claim 3, wherein the dust collecting electrode and the power module are electrically connected through a wire that extends from the power module, the circular holes on the dust collecting electrode are arranged in a circular array or a rectangle array, and each of the circular holes has a bore diameter of 5-50 mm.

5. The low temperature plasma air purifier with high speed ion wind self-adsorption according to claim 1, further comprising a cover provided at the air inlet of the housing, and the cover and the housing in direct communication and detachable from each other.

* * * * *